US005236506A

United States Patent [19]

Mazakas

[11] Patent Number: 5,236,506

[45] Date of Patent: Aug. 17, 1993

[54] METHOD FOR INSTALLING A PORTABLE SPRAY BOOTH LINER

[76] Inventor: Russell Mazakas, 1691 Solano, Ontario, Calif. 91764

[21] Appl. No.: 906,264

[22] Filed: Jun. 26, 1992

Related U.S. Application Data

[63] Continuation-in-part of Ser. No. 851,743, Mar. 16, 1992, which is a continuation-in-part of Ser. No. 725,021, Jul. 3, 1991, abandoned.

[51] Int. Cl.[5] ..... B05C 15/00; B05B 15/12

[52] U.S. Cl. ..... 118/634; 427/421; 118/309

[58] Field of Search ..... 118/634, 309, 326; 55/DIG. 46; 52/2.11, 2.15, 2.25, 79.5; 427/421

[56] References Cited

U.S. PATENT DOCUMENTS 4,845,910 7/1989 Hanson et al. ..... 52/DIG. 13

4,924,803 5/1990 Celant ..... 118/326

FOREIGN PATENT DOCUMENTS 8902788 4/1989 World Int. Prop. O. .

*Primary Examiner*—W. Gary Jones

*Assistant Examiner*—Charles K. Friedman

*Attorney, Agent, or Firm*—Blakely, Sokoloff, Taylor & Zafman

[57] ABSTRACT

A liner module that can be coupled to a spray booth. The module includes a liner folded into a portable cabinet. The liner has a zipper that closes a liner cavity. The liner can be unfolded from the cabinet, unzipped and attached to the inner walls of the spray booth. An electrostatic paint gun is typically used to spray paint powder onto an object located within a spray chamber of the booth. The spray gun produces excess paint powder which is drawn into a filter system. The liner is constructed to prevent the excess paint powder from adhering to the inner walls of the spray booth. The module also contains a primary filter that captures the paint powder as the powder is pulled from the spray booth into the filter system.

3 Claims, 6 Drawing Sheets

FIG. 2
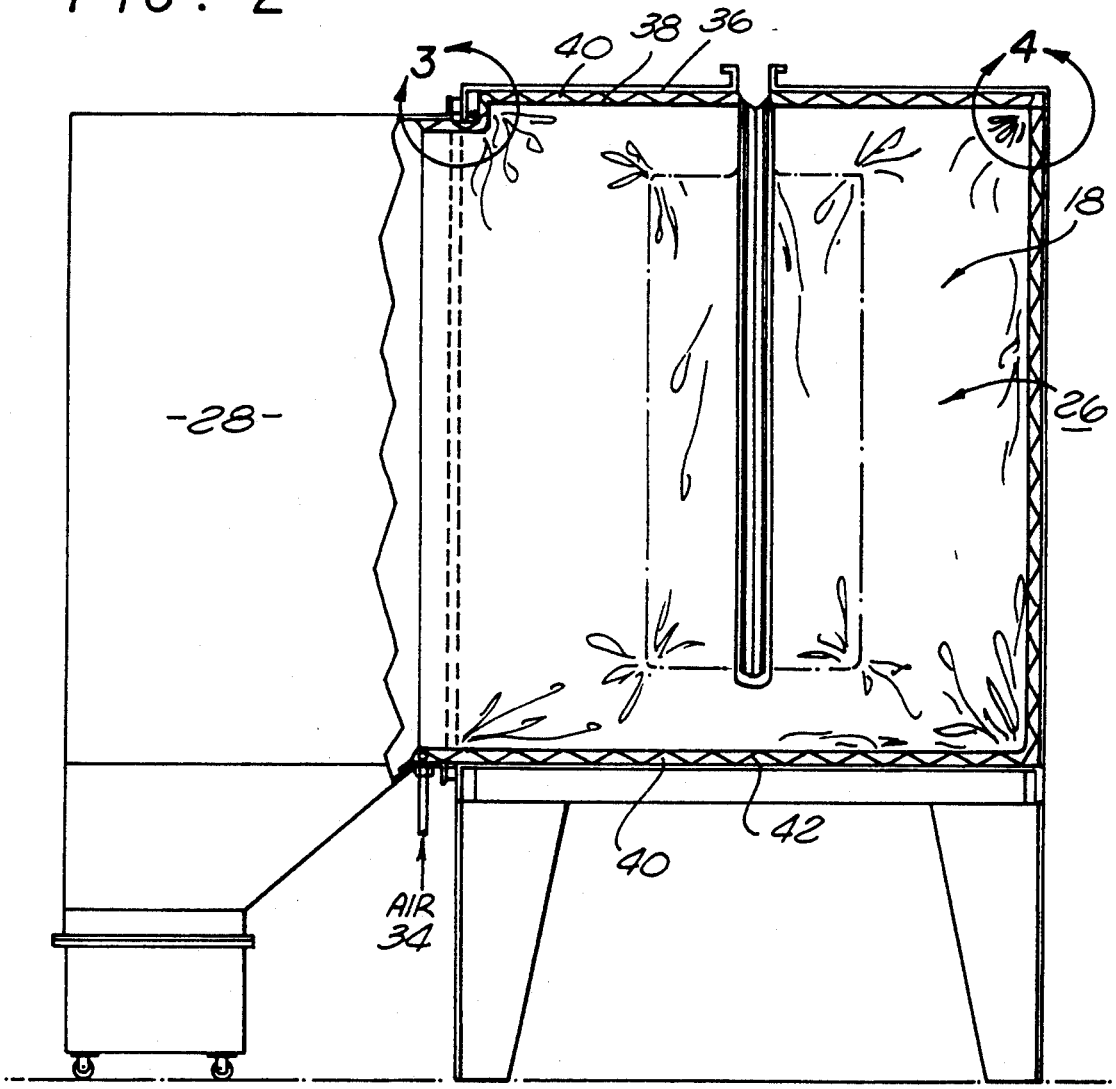
FIG. 3
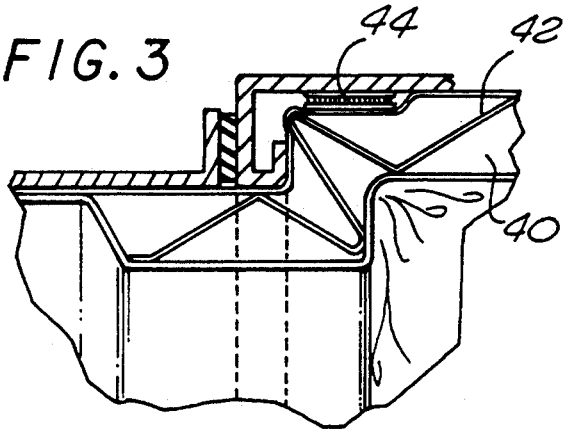
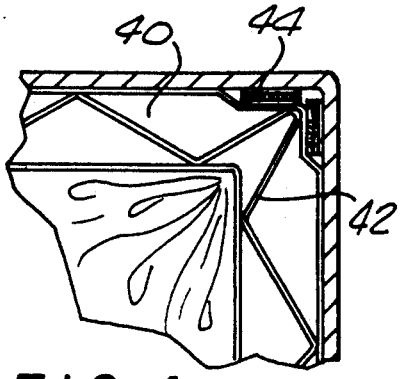
FIG. 4

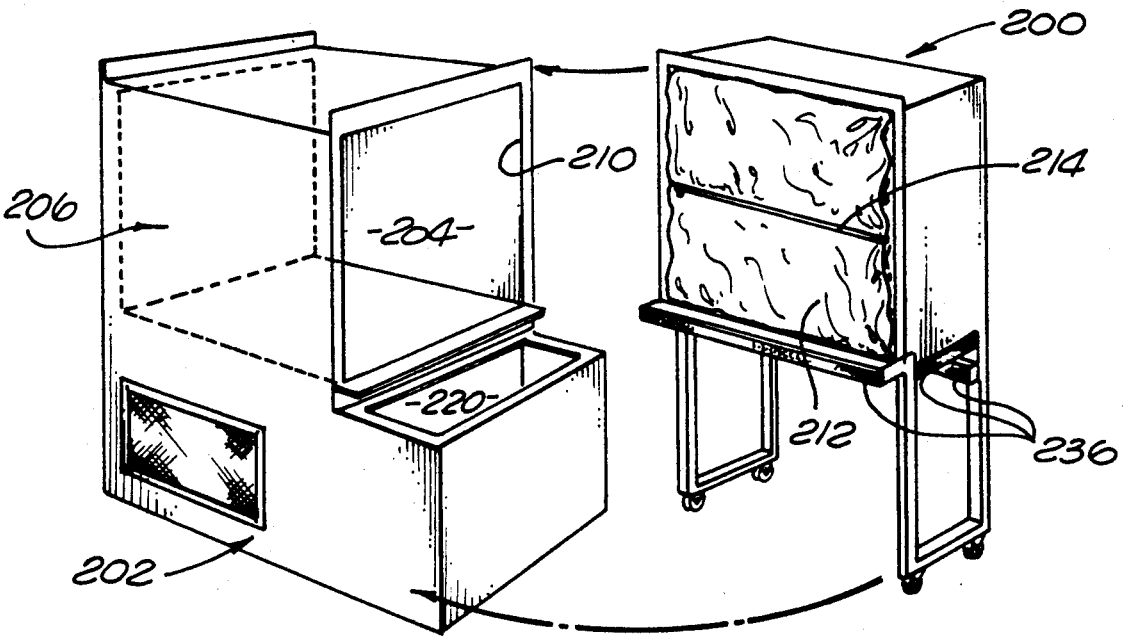
FIG. 11
FIG. 12
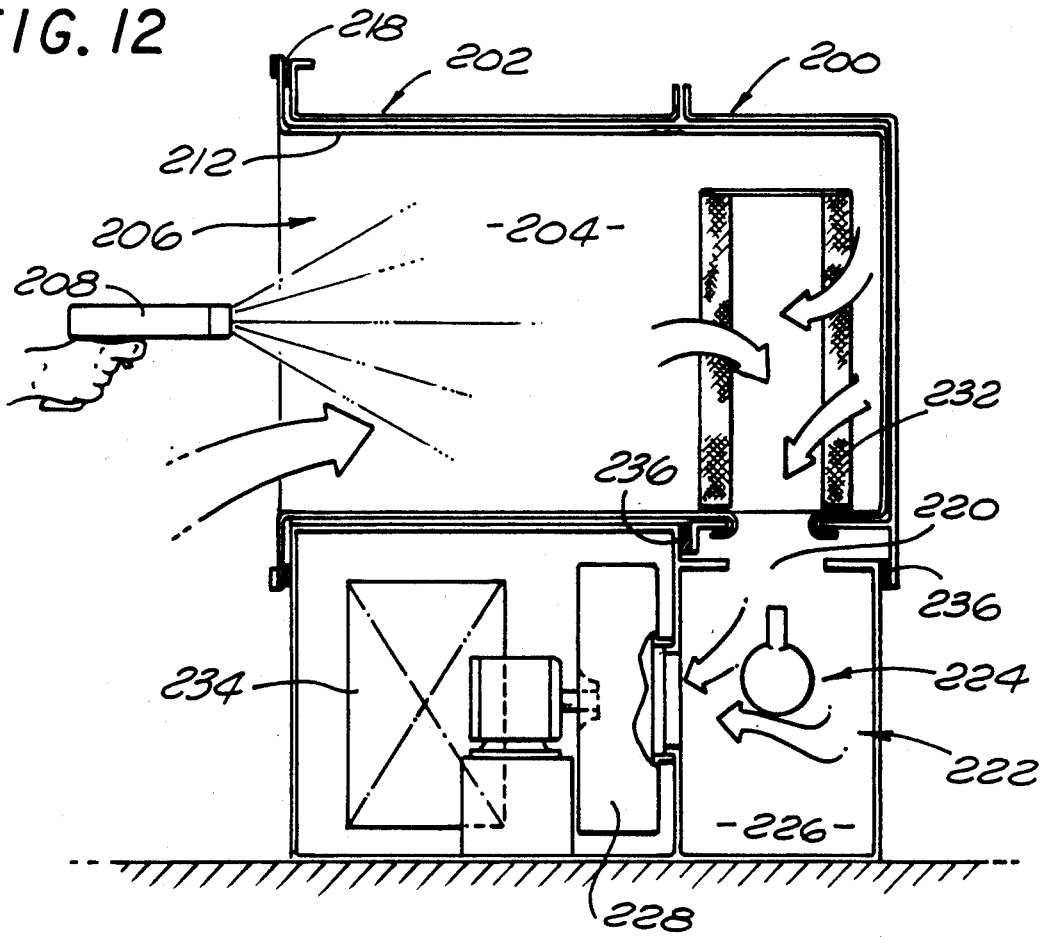

METHOD FOR INSTALLING A PORTABLE SPRAY BOOTH LINER

This application is a continuation-in-part of application Ser. No. 07/851,743, filed on Mar. 16, 1992 which is a continuation-in-part of application Ser. No. 07/725,021 filed on Jul. 3, 1991 now abandoned.

BACKGROUND OF THE INVENTION

1. Field of the Invention

This invention relates to spray booths used to coat workpieces with electrically charged resin powder.

2. Description of Related Art

Electrostatic powder paint spray booths are becoming much more common because of the hardened and improved finish provided by such methods, and the much reduced pollution resulting therefrom. This type of painting comprises spraying electrically charged paint powder onto workpieces that are at ground potential. The charged powder is attracted and adheres to the grounded workpieces, which are then baked in an oven to melt the powder, causing the powder to flow and cover the workpieces. Typically the pieces are hung on racks that pass through a spray booth, wherein a spray gun applies the powdered paint as the parts pass by. The booth is usually a rectangular box with entrance and exit openings, and a slot along the top to allow the hangers and parts to pass through the booth. The booths typically also have a filter system to remove and recover the excess powder that does not adhere to the parts, it being found that the powder will not stick to the pieces after a certain thickness of powder has built up on the part to neutralize the charge.

The spray gun and filter are usually a detachable unit so that it is easy to convert those parts of the spray booth system to a new color. Unfortunately the powdered resin also sticks to the inside of the rectangular booth, which is typically constructed from metallic walls that attract the charged paint powder. When the booth is converted to a new color, the inside of the booth must be cleaned of old powder to insure that none of the old color powder mixes with the new color powder. This is a costly, time consuming task that can shut down a whole assembly line for a long time.

U.S. Pat. No. 4,924,803 issued to Celant and Danish Reference No. 89/02788 by Andersen disclose a single plastic liner that covers the inside of the booth, wherein the liner can be removed and replaced by a different liner when a color change is desired. The single liner concept is difficult and dangerous to install. When the single liner is blown into place within the inside of the paint booth, air will leak out through the zippers and other necessary unsealable openings. Because the walls of the liner contain powder, the air that leaks out of the inflated cover will also contain powder. The powder is toxic, wherein the release of paint into the surroundings will create an undesirable environmental condition. Thus it is not practical to blow-up a single liner of the prior art with air to install it in the spray booth chamber. Additionally, both the Celant and Andersen devices require pressure or vacuum means to install and suspend the liners, thereby increasing the complexity and cost of the installation and overall assembly.

SUMMARY OF THE INVENTION

The present invention is a liner module that can be coupled to a spray booth. The module includes a liner folded into a portable cabinet. The liner has a zipper that closes a liner cavity. The liner can be unfolded from the cabinet, unzipped and attached to the inner walls of the spray booth. An electrostatic paint gun is typically used to spray paint powder onto an object located within a spray chamber of the booth. The spray gun produces excess paint powder which is drawn into a filter system. The liner is constructed to prevent the excess paint powder from adhering to the inner walls of the spray booth. The module also contains a primary filter that captures the paint powder as the powder is pulled from the spray booth into the filter system.

The cabinet is portable so that different modules, each associated with a different paint color, can be coupled to the booth. To change paint colors, the liner is zipped and folded back into the cabinet. The excess paint powder within the spray chamber is contained by the inner cavity of the liner. The liner prevents excess paint powder from adhering to the walls of the spray booth so that one paint color is not contaminated by paint powder of a different color.

Therefore it is an object of this invention to provide a spray booth liner that can be readily attached to and removed from a spray booth.

BRIEF DESCRIPTION OF THE DRAWINGS

The objects and advantages of the present invention will become more readily apparent to those skilled in the art after reviewing the following detailed description and accompanying drawings, wherein:

FIG. 2 is a side view of a double layered liner inflated and attached to the inner cavity of a spray booth;

FIG. 3 is an exploded view of FIG. 2, showing the attachment of the portable cabinet and liner to the spray booth;

FIG. 4 is an exploded view of FIG. 2, showing the attachment of the liner to a corner of the booth cavity and a corrugated member between the liner walls to add structural support to the liner;

FIG. 11 is a perspective view of another alternate embodiment of the present invention;

FIG. 12 is a cross-sectional view of a liner extending from a portable cabinet and attached to the inner walls of a spray booth.

DETAILED DESCRIPTION OF THE INVENTION

Figure 1:
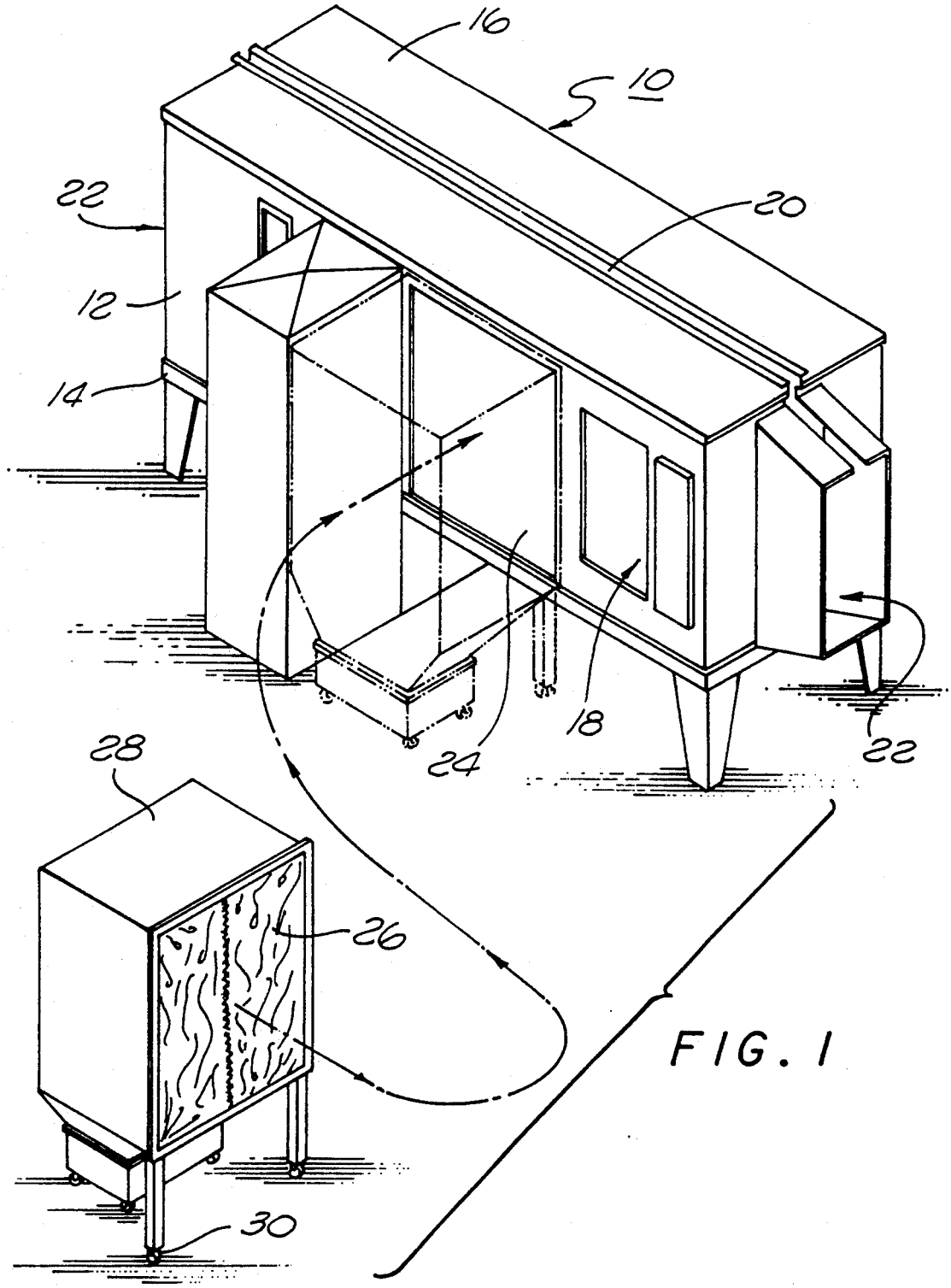
FIG. 1 is a perspective of a paint spray booth showing the attachment of a portable cabinet having an inflatable double layered liner.

Referring to the drawings more particularly by reference numbers, FIG. 1 shows a paint spray booth 10 typically used to enclose workpieces (not shown) that are sprayed by an electrostatic spray gun. The booth 10 comprises four walls 12, a floor 14 and a ceiling 16, that encloses a booth cavity 18. The booth 10 has a slot 20 and openings 22 that allow the parts, which are hung on hangers that move along a conveyor, to pass through the booth 10. The booth 10 has an access window 24 to allow a liner 26 to be inserted into the cavity of the booth 10. The liner 26 can be packed into a cabinet 28. The cabinet 28 may have wheels 30 allowing the cabinet 28 to be rolled to and from the access window 24, such that the cabinet 28 can be easily transported and attached to the booth 10. There may be a plurality of portable cabinets, each cabinet 28 corresponding to a different powder color.

FIG. 2 shows the liner 26 installed within the cavity 18 of the booth 10. Installation may be accomplished by unfolding the liner 26 from the cabinet 28, attaching the liner 26 to the booth walls 12 and ceiling 16 and inflating the liner 26 with a fluid medium 34, preferably air, from a compressor or the like (not shown). The liner 26 has a first outside layer 36 constructed to conform to the shape of the booth cavity 18 and a second inside layer 38 attached to the first layer 36, such that there is an inflatable compartment 40 between the first 36 and second 38 layers. The layers are made from a flexible bag like material that allows the compartment 40 to expand when air 34 is introduced to the same. To add structural support to the compartment 40, a support member 42 may be inserted between the first 36 and second 38 layers. In the preferred embodiment, the support member 42 is a corrugated sheet extending through the compartment 40, with the sheet being constructed from a flexible material such that the liner 26 easily collapses when the compartment 40 is deflated. The spring like sheet also aids the expansion of the compartment 40, by inducing separation of the layers to make sure certain portions of the liner 26 are not pinched or collapsed. It being desirable to have the electrically insulating air gap separating the booth and charged powder over as much area as possible, to prevent the attraction of the powder to the metallic booth walls. The second inside layer 38 can be porous, allowing the pressurized air 34 to blow through said layer 38 into the cavity 18, to prevent powdered paint from attaching to the liner 26. With this embodiment, the compressor or other source of air would have to be in constant operation to supply a constant source of pressurized air 34. The porous second inside layer can be constructed by creating a plurality of small apertures throughout the second layer 38. The liner 26 may be attached to the booth by hook and loop material sold under the Trademark "VELCRO" 44, as shown more clearly in FIGS. 3 and 4, wherein the liner 26 has patches of loops that mate with corresponding hooks attached to the booth 10. The liner 26 may be connected to the booth 10, by hooks, or hangers or any other suitable means for covering the cavity 32 walls.

The liner 26 could be constructed such that the liner 26 could cover the cavity walls without being attached to the booth 10, an embodiment particularly viable for small booths. The liner 26 would be inflated into the desired predetermined shape after the liner 26 is unfolded inside the booth cavity 18. The corrugated sheet 42 could provide additional structural support to help suspend the liner 26 within the booth cavity 18. FIGS. 3 and 4 show desirable sheet 42 shapes to help define the corners of the liner 26. The cabinet 28 and liner 26 could be constructed, such that the liner 26 is inflated while still in the cabinet 28, wherein the liner 26 "opens up" into the booth 10. In this arrangement the liner 26 would still have to be folded back into the cabinet 28 after the compartment 40 is deflated.

Figure 5:
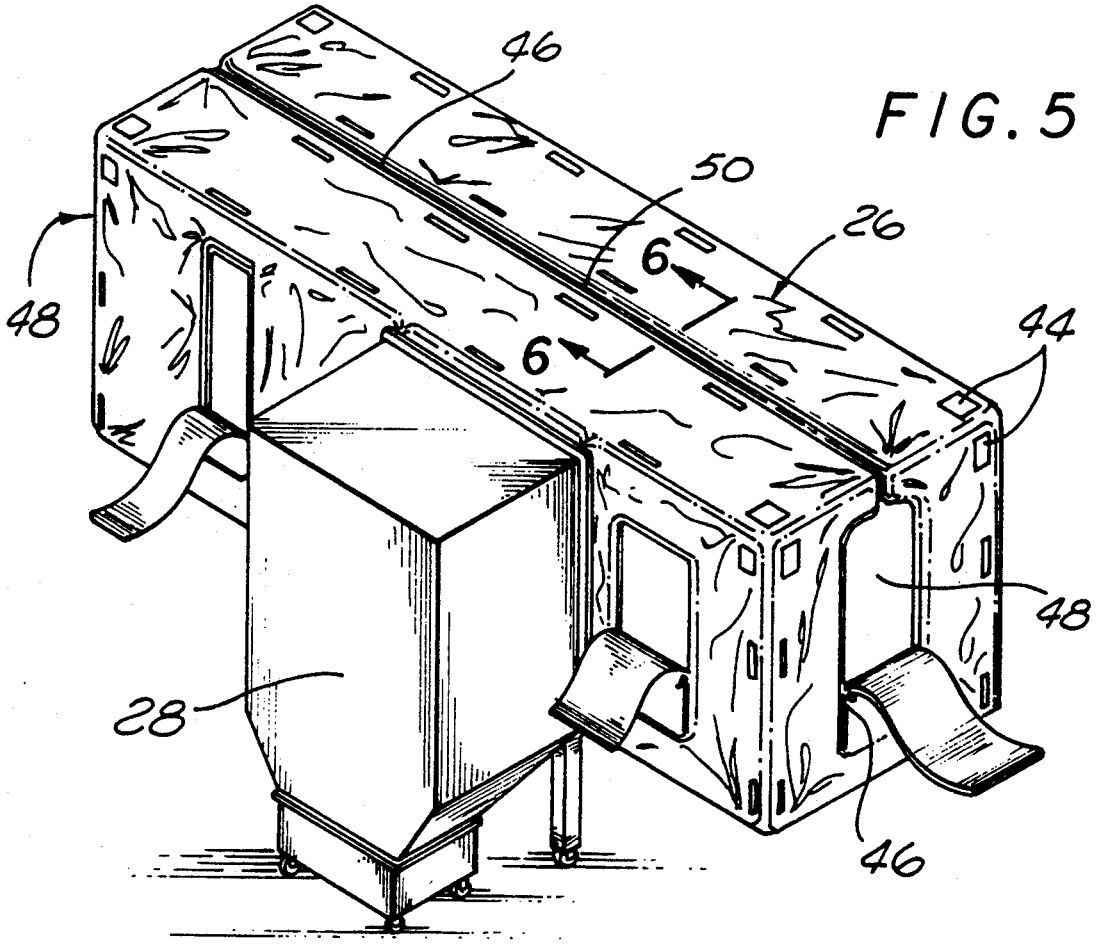
FIG. 5 is a perspective view of an inflated double layered liner showing zippers that expose openings and a slot to allow workpieces (not shown) to pass through the booth.
Figure 6:
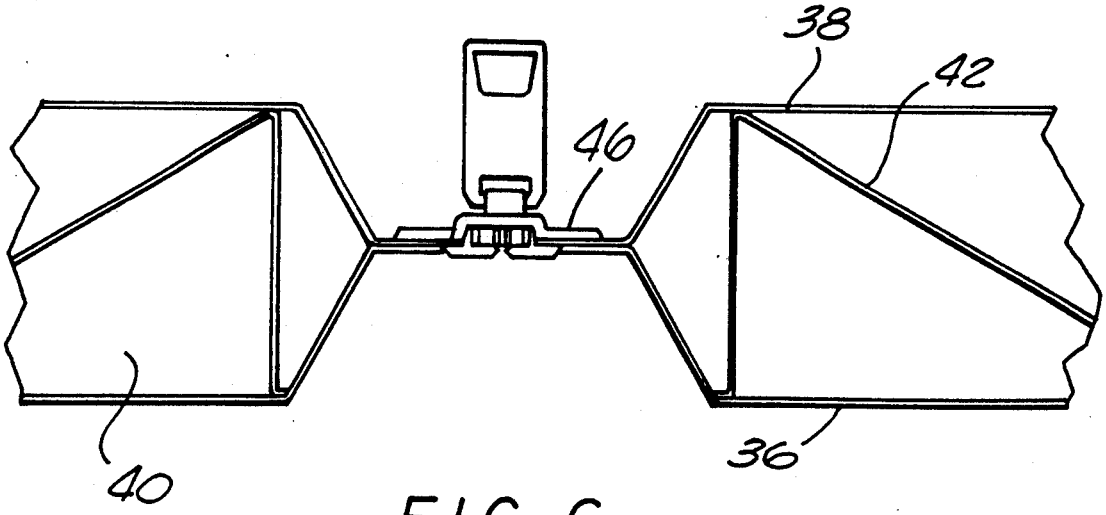
FIG. 6 is a cross-sectional view of FIG. 5 showing a zipper attached to the liner.

FIG. 5 shows an inflated liner 26, with zippers 46 that unzip portions of the liner 26, such that there are liner openings 48 and a liner slot 50 that are of approximately the same dimensions and locations as the openings 22 and slot 20 of the booth 10. The openings 48 and slot 50 allow workpieces to travel through the liner 26 and booth 10. The zippers 46 can also create side openings 51 to allow further access to the cavity for the spray gun or for other means. There may be another side opening on the opposite side (not shown) for spray gun access. FIG. 6 more clearly shows the attachment of the zipper 46 to the liner 26, wherein the zipper 46 seals off the compartment 40. The liner openings 48 and slot 50 can also be attached with hook and loop material or other fastening means.

To install the preferred embodiment a portable cabinet 28 is rolled up to the access window 24. The liner 26 is unfolded into the booth cavity 18. The compartment 40 is then inflated to a point where it can be attached to the cavity walls 12. The zippers 46 are unzipped creating the openings 48 and slot 50. The liner 26 is then ready for use. When a new color is desired, the liner 26 is zipped, deflated, detached and folded back into the cabinet 28, which is wheeled away and replaced by another cabinet 28 to be used with the new color.

The liner 26 could be utilized as a self-supporting paint spray enclosure, wherein the liner is used without a metallic booth 10. The layer material and/or corrugated sheets could provide enough structural rigidity such that the liner is defined and self-supported as shown in FIG. 5. To provide further support, the corners of the liner 26 could be tied to the floor and ceiling such that the liner is suspended like a tent. Thus the present invention could be used as a replacement for the expensive heavy booths that are used today. By deflating and removing the liner the floor space can then be utilized for other uses.

Figure 7:
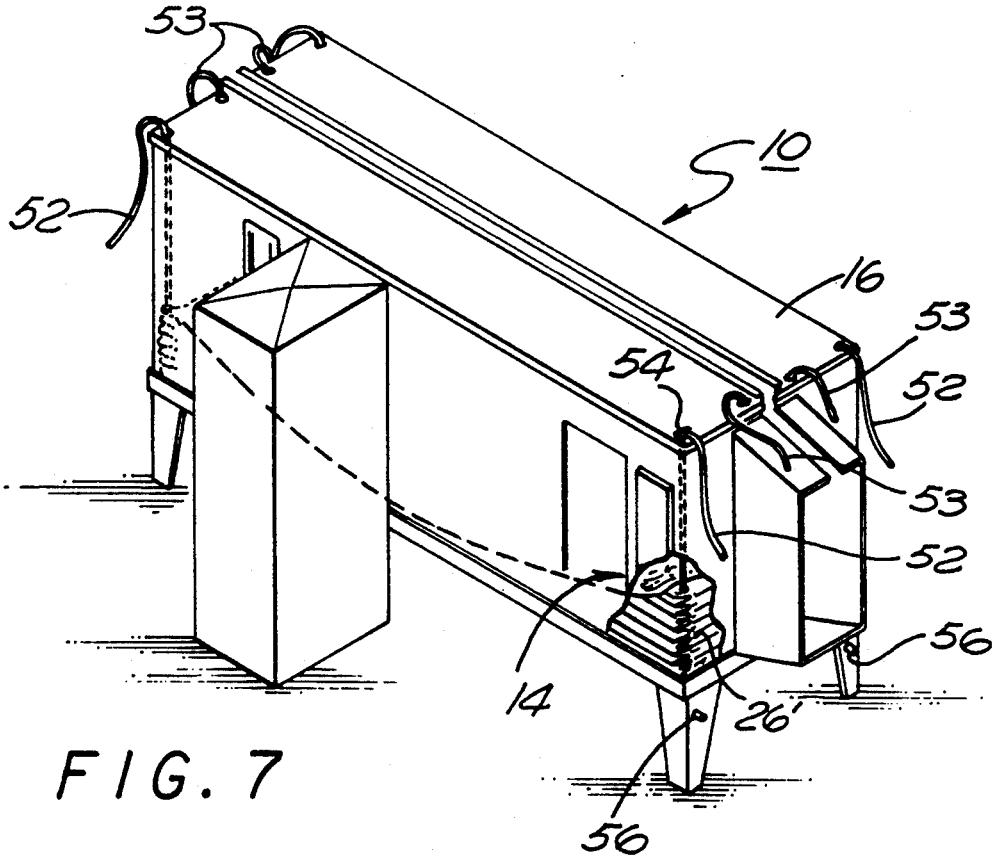
FIG. 7 is a perspective view showing a spray paint booth with a liner than can be lifted into position by cables.
Figure 8:
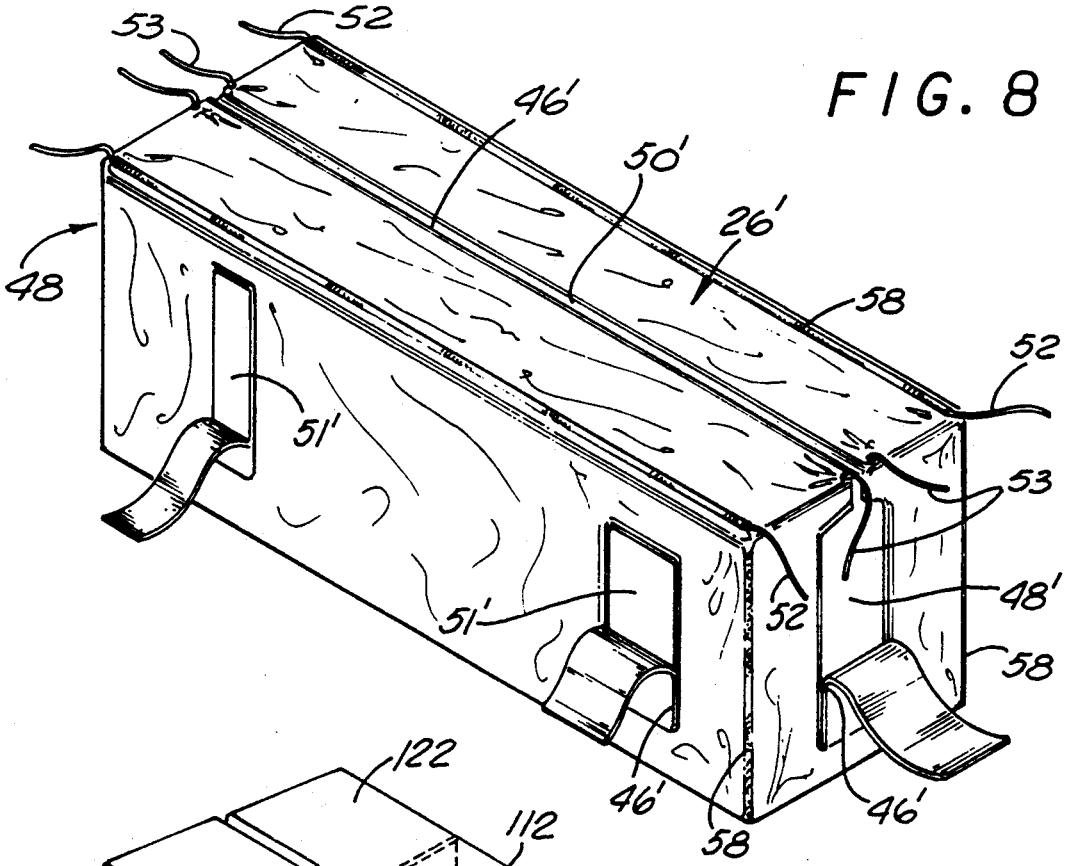
FIG. 8 is a perspective view similar to FIG. 5, showing the liner of FIG. 7.

FIGS. 7 and 8 show an alternate embodiment of a single layer liner 26' that can be lifted into position from outside the spray booth 10. The liner 26' may have zippers 46' that allows openings 48' and 51', and a slot 50' to be formed therein. The corners of the liner 26' can be attached to cables 52 that extend through openings 54 in the booth 10. The liner 26' may also have cables 53 attached to the edges of the liner adjacent to the slot 50'. The cables 53 insure that the liner 26' is adjacent to the cavity wall in the area around the slot 50'.

Figure 9:
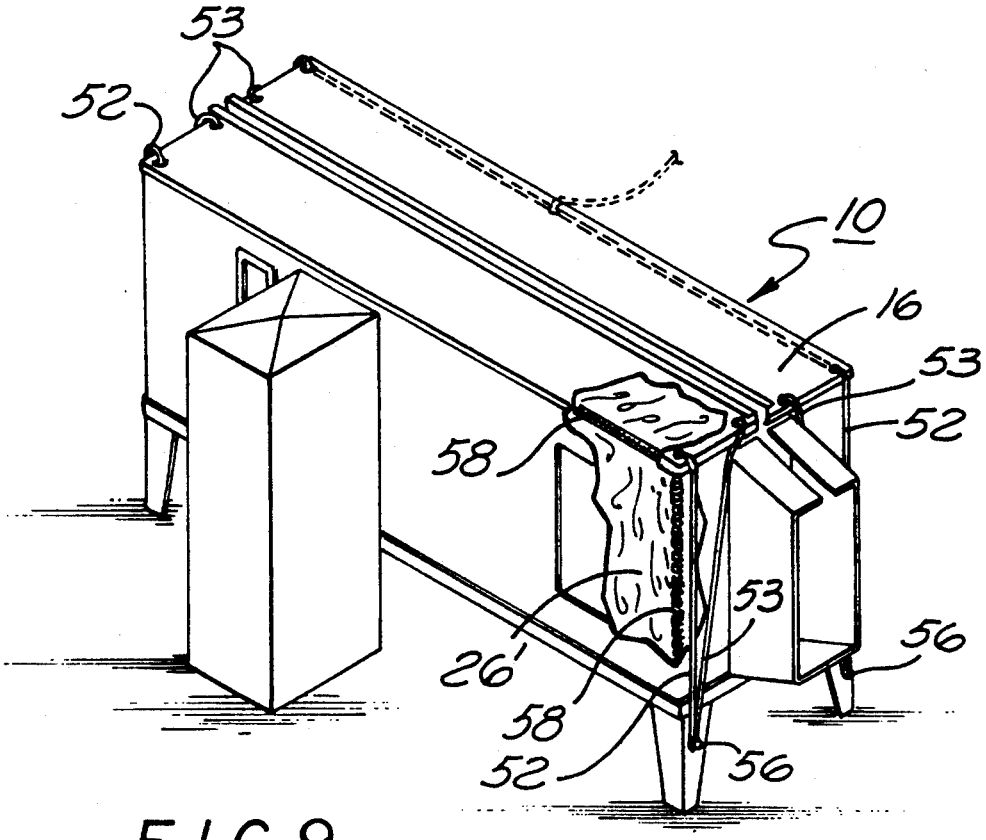
FIG. 9 is a view similar to FIG. 7 showing the liner lifted into an operating position.

The liner 26' is initially in a flat position on the floor 14 of the booth. As shown in FIG. 9, the liner 26' is lifted into position by pulling the cables 52 and 53 in a downward direction, until the top and sides of the liner 26' completely cover the inner surface of the booth 10. The bottom corners of the liner 26' are typically fastened to the floor 14, to prevent the bottom of the liner from being pulled up by the cables.

To keep the liner 26' upright, the cables 52 can be tied to studs 56 extending from the legs of the booth 10. The liner 26' may have four individual cables 52, or two pairs of cables as shown in phantom in FIG. 9. The combination of cables reduces the number of people or steps needed to lift the liner 26'. The edges of the liner 26' preferably have an elastic element 58 or material therein, so that when the cables are untied, the elastic material 58 pulls the liner 26' back into the flat position. The liner 26' can then be folded and removed from the booth. A new liner may be unfolded onto the floor 14 and lifted into place. The new liner is typically used when a different color of paint is sprayed onto the workpieces. The cables 52 and 53 can be attached to a single layer liner or the double layer liner shown in FIGS. 1-6.

Figure 10:
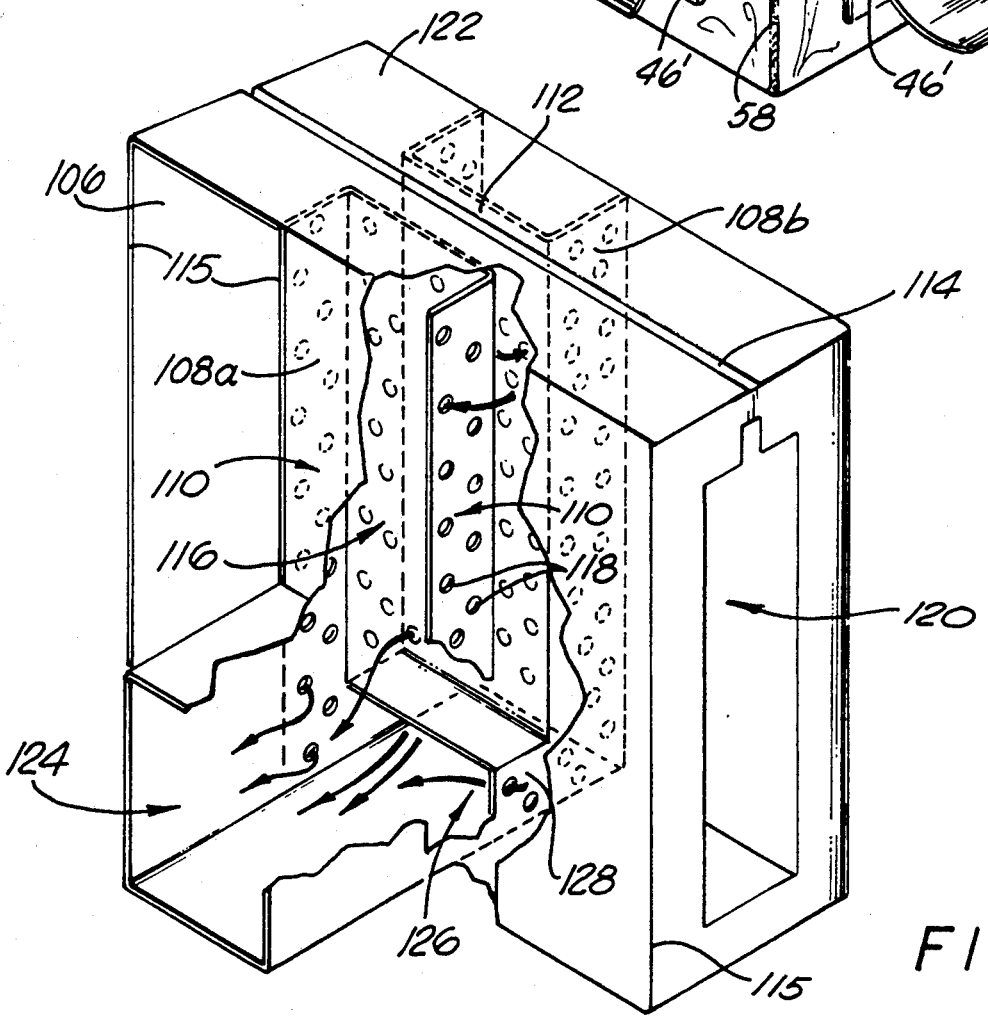
FIG. 10 is a perspective view of another alternate embodiment of the present invention, wherein the liner has a pair of air ducts integrated therein.

FIG. 10 shows another embodiment of the present invention, wherein the liner 106 has a pair of air ducts 108*a* and 108*b* integrated therein. The liner 106 may be the double layer liner shown in FIGS. 1-6 or the single layer liner shown in FIGS. 7-9. Each duct 108 typically has a pair of sidewalls 110 that extend from the liner 106. Attached to each sidewall 110 is a front wall 112 that is essentially parallel with the slot 114. The edges of the walls may contain elastic material 115, so that the ducts 108 readily collapse when the cables are released (single layer), or the compartment is deflated (double layer). The ducts 108 have inner passages 116 extending the length of the walls. Each wall also has a plurality of holes 118 that provide communication between the inner cavity 120 of the booth 122 and the passages 116.

Attached to the booth 122 is a filter unit 124 that contains a number of filters (not shown) that remove the electrostatic paint powder from the air. The liner 106 has an opening 126 that provides communication between the duct passage 116 and the filter unit 124. Because only one filter is typically employed, the liner 106 may include a secondary duct 128 that allows air to flow from the duct 108*b* to the duct 108*a*. A fan unit (not shown) is typically employed to pull the air from the inner cavity 120 of the booth, through the filters and into the ambient. The ducts provide a means for directing the paint powder to the filter, thereby reducing the amount of paint powder that adheres to the liner 106.

FIGS. 11 and 12 show another embodiment of the present invention, which includes a portable cabinet 200 that can be coupled to a stationary spray booth 202. The spray booth 200 has a spray chamber 204 large enough to contain one or more objects (not shown) that are to be painted. The booth 200 has a front opening 206 through which a spray gun 208 sprays electrostatically charged dry paint powder into the spray chamber 204. The cabinet 200 has a rear opening 210 which provides access to a liner 212. The liner 212 is constructed from a material that is impermeable to the paint powder and has the form of a bag. The liner 212 includes a zipper 214 that provides access to a liner cavity. The cabinet 200 also has wheels that allow the liner 212 to rolled to and from the spray booth 202. A typical paint area may have a plurality of cabinets 200 each used with an associated paint color.

As shown in FIG. 12, the cabinet 200 is rolled up to the rear opening 210 of the booth 202. The liner 212 is then unfolded into the spray chamber 204. The zipper 214 is unzipped and the liner 212 is then attached to the spray booth 202. The liner 212 may be secured to the walls of the booth 202 by any fastening means 218. For example, the outer surface of the liner 212 and the inner surface of the booth 202 may have hook and loop material (VELCRO) that allow the members to be fastened together. The liner 212 covers the entire surface of the spray booth 202 so that paint powder does not adhere to the walls of the booth 202.

The cabinet 200 has a filter opening 220 that allows fluid communication between the spray chamber 204 and a filter assembly unit 222. The filter unit 222 includes a blow down filter 224 within a blow down chamber 226 and an exhaust fan 228 that pulls air from the spray chamber 204. The fan 228 is constructed to provide an air flow high enough to circulate the paint powder without preventing attachment of the powder to the part.

A primary filter 232 may be placed above the opening 220. The primary filter 232 typically remains within the liner 212 even when the cabinet 200 is detached from the booth 202. The primary filter 232 is constructed to capture the paint powder as the air flows from the spray chamber 204 into the opening 220. Any powder that escapes the primary filter 232 can be captured by the blow down filter 224. The unit 222 may have an exhaust filter 234 to insure that no powder is blown back into the ambient.

When a new paint color is desired, the liner 212 is detached from the paint booth 202, zipped, folded back into the cabinet 200 and rolled away from the booth 202. A new cabinet with another associated color is then rolled up to the booth and the enclosed liner is installed. The spray booth 202 and filter unit 222 may have gaskets 236 that seal the cabinet 200 to the booth 202 and unit 222. In the alternative, the gaskets 236 may be attached to the cabinet 200. What is thus provided is a portable liner that allows the user to readily change paint colors without cleaning the walls of the spray booth.

While certain exemplary embodiments have been described above and shown in the accompanying drawings, it is to be understood that the embodiments are merely illustrative of, and not restrictive on the broad invention, and that this invention should not be limited to the specific constructions and arrangements shown and described, since various other modifications may occur to persons having ordinary skill in the art.

What is claimed is:

1. A method of covering inner walls of a spray booth which contains workpieces that are sprayed with electrostatic paint powder, wherein the spray booth has a first opening, comprising:

a) providing a portable cabinet that has a liner which can be moved between a folded position and an unfolded position, said liner having a zipper which can be manipulated to create a first liner opening and fastening means for attaching said liner to the inner walls of the spray booth;

b) moving said portable cabinet adjacent to the first opening of the spray booth;

c) pulling said liner into the unfolded position;

d) manipulating said zipper to create said first liner opening; and;

e) attaching said liner to the inner walls of the spray booth.

2. The method as recited in claim 1, further comprising the steps of;

f) detaching said liner form the inner walls of the spray booth;

g) manipulating said zipper to close said first liner opening;

h) folding said liner into said portable cabinet;

i) moving said portable cabinet away from the first opening of the spray booth.

3. The method as recited in claim 2, further comprising the steps of;

b) moving said portable cabinet adjacent to the first opening of the spray booth;

c) pulling said liner into the unfolded position;

d) manipulating said zipper to create said first liner opening; and, e) attaching said liner to the inner walls of the spray booth.

* * * * *

UNITED STATES PATENT AND TRADEMARK OFFICE

CERTIFICATE OF CORRECTION

PATENT NO. : 5,236,506

DATED : August 17, 1993

INVENTOR(S) : Mazakas

It is certified that error appears in the above-identified patent and that said Letters Patent is hereby corrected as shown below:

In claim 2 in column 6 at line 54 change "form" to --from--.

Signed and Sealed this

Thirteenth Day of June, 1995

Bruce Lehman

*Attest:*

BRUCE LEHMAN

*Attesting Officer*

*Commissioner of Patents and Trademarks*